US007380346B1

(12) United States Patent
Emerson

(10) Patent No.: US 7,380,346 B1
(45) Date of Patent: Jun. 3, 2008

(54) TOOL FOR LOCATING AND MARKING PLACEMENT OF MOUNTING PINS

(76) Inventor: Jeffrey Emerson, 13557 Jonquil St. NW., Andover, MN (US) 55304

( * ) Notice: Subject to any disclaimer, the term of this patent is extended or adjusted under 35 U.S.C. 154(b) by 0 days.

(21) Appl. No.: 11/561,059

(22) Filed: Nov. 17, 2006

Related U.S. Application Data

(60) Provisional application No. 60/738,480, filed on Nov. 21, 2005.

(51) Int. Cl.
*G01D 21/00* (2006.01)

(52) U.S. Cl. ..... 33/613; 248/475.1

(58) Field of Classification Search ..... 248/467, 248/475.1, 480, 205.3, 544, 466, 497; 33/613, 33/645, 666, 669, 677, 528, DIG. 10
See application file for complete search history.

(56) References Cited

U.S. PATENT DOCUMENTS 4,228,982 A * 10/1980 Sellera ..... 248/467
5,605,313 A * 2/1997 Erickson et al. ..... 248/467
5,961,090 A * 10/1999 Parkin ..... 248/475.1
6,095,465 A * 8/2000 Weck et al. ..... 248/205.3
6,651,945 B2 * 11/2003 Rivellino et al. ..... 248/206.5
2002/0083612 A1 * 7/2002 Prather ..... 33/666
2006/0075650 A1 * 4/2006 Tatum ..... 33/666

* cited by examiner

*Primary Examiner*—Ramon O Ramirez
(74) *Attorney, Agent, or Firm*—Sherrill Law Offices, PLLC

(57) ABSTRACT

A tool with a laterally and longitudinally extending open-sided channel, a protuberance projecting in a first transverse direction forward the front face of the tool and a second protuberance projecting in a second transverse direction rearward the rear face of the tool.

The tool, with or without the second protuberance, may be used to hang an item upon a wall by (a) attaching the tool to a sawtooth hanger or a mounting orifice on the item, (b) supporting the item against a vertical surface at a desired hanging position and orientation, (c) pressing the supported item against the vertical surface with a force sufficient to cause the first protuberance on the tool to mark the vertical surface, (d) moving the item to expose the mark on the vertical surface, (e) securing a mounting pin to the vertical surface proximate the mark, and (f) suspending the item from the mounting pin by the sawtooth hanger or mounting orifice on the item.

6 Claims, 3 Drawing Sheets

TOOL FOR LOCATING AND MARKING PLACEMENT OF MOUNTING PINS

This application claims the benefit of U.S. Provisional Application No. 60/738,480, filed Nov. 21, 2005

BACKGROUND

Items, such as framed works of art, wall-mounted clocks, shelving brackets, a variety of knick knacks, and cabinets for bric-a-bracs, are commonly hung from a wall using one or more sawtooth hangers nailed to the back of the frame. The sawtooth hangers each engage an appropriately placed nail or hook (collectively referenced as a mounting pin) that is driven into or fastened onto the wall. Alternatively, such items are also commonly hung from a wall by placing the mounting pin within a mounting orifice hidden in the back of the item.

Locating mounting pins on a wall to achieve a desired positioning of an item can often be a challenge. While the desired position of the item can be readily observed by simply holding the item against the wall and moving the item until the desired position is observed, location and marking of the position of the mounting pins necessary to achieve the desired positioning of the item on the wall is a little more troublesome as the item obscures viewing and blocks marking of the necessary location of the mounting pins. While careful measurement of the wall and item would seem to be a fitting resolution of the matter, those with experience in this endeavor can attest to the fact that—despite every effort at precision—this technique rarely results in the desired positioning of the item.

Accordingly, a longstanding need exists for a quick, simple and inexpensive way to locate and mark the placement of mounting pins.

SUMMARY OF THE INVENTION

A first aspect of the invention is a tool having (i) a front face, (ii) a laterally and longitudinally extending open-sided channel configured and arranged to accommodate insertion of a central portion of a sawtooth hanger into the channel, and (iii) a protuberance projecting in a first transverse direction forward the front face of the tool.

The first aspect of the invention may optionally include a second protuberance projecting in a second transverse direction rearward the rear face of the tool.

A first embodiment of a second aspect of the invention is a method of hanging an item equipped with a sawtooth hanger upon a vertical surface employing the tool. The method comprises the steps of (a) obtaining the tool described above, with or without the second protuberance, (b) sliding a sawtooth hanger attached to the item into the channel in the tool with the first protuberance projecting away from the item, (c) supporting the item with attached tool relative to a vertical surface at a desired hanging position and orientation, (d) pressing the supported item against the vertical surface with a force sufficient to cause the protuberance on the tool to mark the vertical surface, (e) moving the item to expose the mark on the vertical surface, (f) securing a mounting pin to the vertical surface proximate the mark, and (g) suspending the item from the driven mounting pin by the sawtooth hanger on the item.

A second embodiment of the second aspect of the invention is a method of hanging an item equipped with a mounting orifice upon a vertical surface employing the tool. The method comprises the steps of (a) obtaining the tool described above with the second protuberance, (b) inserting the second protuberance on the tool into the mounting orifice in the item, (c) supporting the item with attached tool relative to a vertical surface at a desired hanging position and orientation, (d) pressing the supported item against the vertical surface with a force sufficient to cause the first protuberance on the tool to mark the vertical surface, (e) moving the item to expose the mark on the vertical surface, (f) securing a mounting pin to the vertical surface proximate the mark, and (g) suspending the item from the driven mounting pin by positioning the item over the driven mounting pin so as to position the pin within the mounting orifice in the item.

DETAILED DESCRIPTION OF A PREFERRED EMBODIMENT

Nomenclature

Figure 1:
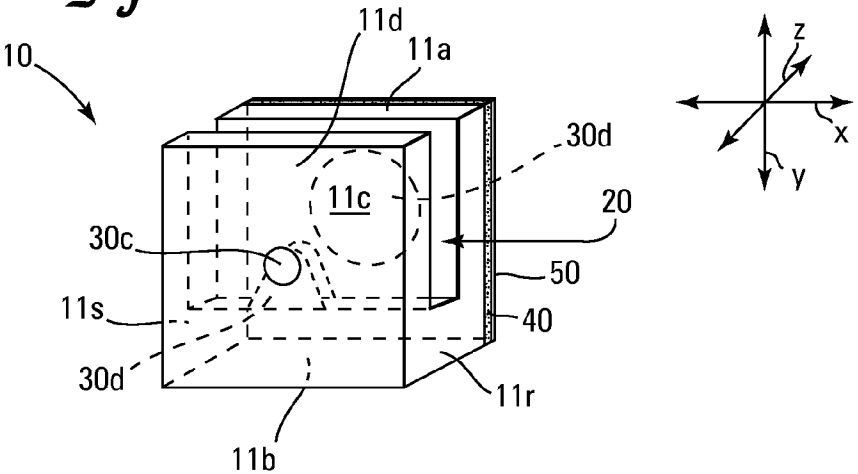
FIG. 1 is perspective view of one embodiment of the invention.
Figure 2:
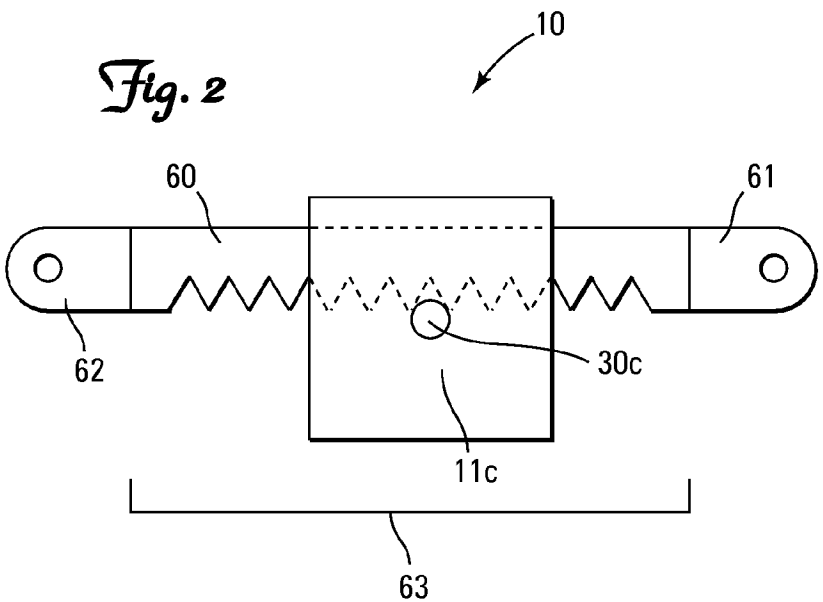
FIG. 2 is a front view of the invention shown in FIG. 1 operably engaging a sawtooth hanger.

10 Tool
11*a* Top of Tool
11*b* Bottom of Tool
11*c* Front Face of Tool
11*d* Rear Face of Tool
11*r* Right Side of Tool
11*s* Left Side of Tool
20 Channel in Tool
30*c* First Protuberance
30*d* Second Protuberance
30*e* Bump
40 Layer of Pressure Sensitive Adhesive
50 Release Liner
60 Sawtooth Hanger
61 First End Portion of Sawtooth Hanger
62 Second End Portion of Sawtooth Hanger
63 Central Portion of Sawtooth Hanger
70 Work of Art
80 Frame
86 Rear Face of Frame
90 Wall or Vertical Surface
180 Bracket
189 Key-Hole Slot in Bracket
x Lateral Axis
y Longitudinal Axis
z Transverse Axis
$z_1$ First Transverse Direction
$z_2$ Second Transverse Direction Construction Referring to FIGS. 1 and 2, the invention is a tool 10 having a top 11*a*, a bottom 11*b*, a front face 11*c*, a rear face lid, a right side 11*r* and a left side 11*s*. The tool 10 includes (i) a laterally x and longitudinally y extending open-sided channel 20 configured and arranged to accommodate insertion of a central portion 43 of a sawtooth hanger 60 into the channel 20 when the first and second ends (61 and 62) of the sawtooth hanger 60 are attached to a substrate, such as the rear face 86 of a frame 80 framing a work of art 70, (ii) a transversely z projecting first protuberance 30*c* projecting in a first transverse direction $z_1$ forward the front face 11*c* of the tool 10, (iii) a second protuberance 30*d* projecting in a second transverse direction $z_2$ rearward the rear face 11*d* of the tool 10, (iv) a layer of a pressure sensitive adhesive 40 on at least a portion of the rear face lid of the tool 10, and (v) a release liner 50 covering the layer of pressure sensitive adhesive 40. The channel 20 in the embodiment depicted in FIGS. 1 and 2 is accessible from the top 11*a* of the tool 10.

If desired the tool 10 can be constructed with only one of the channel 20 or a combination of the second protuberance 30*d*, adhesive layer 40 and release liner 50.

Referring to FIG. 1, a bump 30*e* with an apex (unnumbered) transversely z aligned with the first and second protuberances 30*c* and 30*d* can be provided within the channel 20 for facilitating centering of the tool 10 onto a sawtooth hanger 60 as shown in FIG. 2.

The tool 10 can be made of substantially any solid material possessing the necessary structural integrity, including specifically but not exclusively, fiberglass, metal, plastic, high durometer rubber, wood, etc. The tool 10 can have any desired size and shape capable of performing the intended function of the tool 10. The size of the tool 10 is preferably between about 0.5 $cm^3$ and 20 $cm^3$ as a tool 10 smaller than about 0.5 $cm^3$ is easily lost and can be difficult to handle while a tool 10 larger than about 20 $cm^3$ can be overly expensive and cumbersome to use. The shape of the tool 10 is governed only by the need to accommodate the spatial relationship of the channel 20 and the protuberances 30*c* and 30*d*, and the need to operably engage either a sawtooth hanger 60 or a mounting orifice such as a key-hole slot 189. Preferred shapes include a tetrahedron, a cube, a rectangular parallelepiped, a right pyramid, a frustum of right pyramid, a right wedge, a right circular cylinder, a circular right cone, a frustum of a circular right cone, a circular barrel, a spherical sector, etc.

Use

Figure 4:
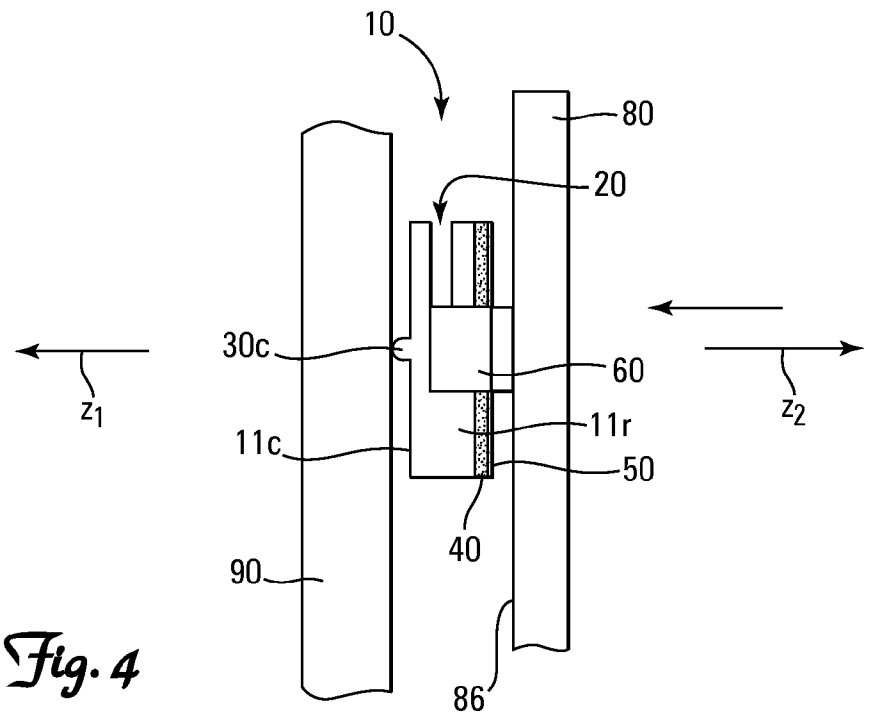
FIG. 4 is a side view of the framed work of art of FIG. 3 held against a wall to be marked with the tool.
Figure 3:
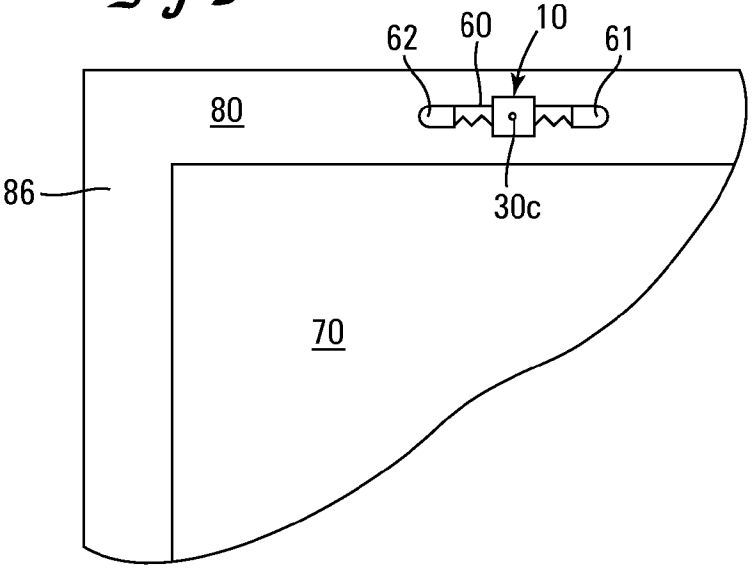
FIG. 3 is a rear view of a framed work of art with a sawtooth hanger attached to the rear face of the frame and the tool of FIG. 1 operably engaging the hanger.

The tool 10 can be used to quickly and easily hang an item, such as a framed work of art 70, equipped with a sawtooth hanger 60 from a vertical surface 90. Referring to FIGS. 3 and 4, the tool 10 is used by (i) sliding the central portion 63 of each sawtooth hanger 60 attached to the framed work of art 70 into the channel 20 of a tool 10 with the first protuberance 30*c* on the tool 10 projecting away from the framed work of art 70, (ii) positioning the apex of the bump 30*e* within a centrally positioned notch (unnumbered) on the sawtooth hanger 60, (iii) supporting the framed work of art 70 with attached tool(s) 10 relative to a vertical surface 90 at a desired hanging position and orientation, (iv) pressing the supported framed work of art 70 against the vertical surface 90 with a force sufficient to cause the first protuberance 30*c* on each tool 10 to mark the vertical surface 90, (v) moving the framed work of art 70 to expose the mark(s) (not shown) on the vertical surface 90, (vi) securing a mounting pin (not shown) to the vertical surface 90 proximate each mark (preferably at each mark), and (vii) suspending the framed work of art 70 from the driven mounting pin(s) by the sawtooth hanger(s) 60 on the framed work of art 70.

Figure 5:
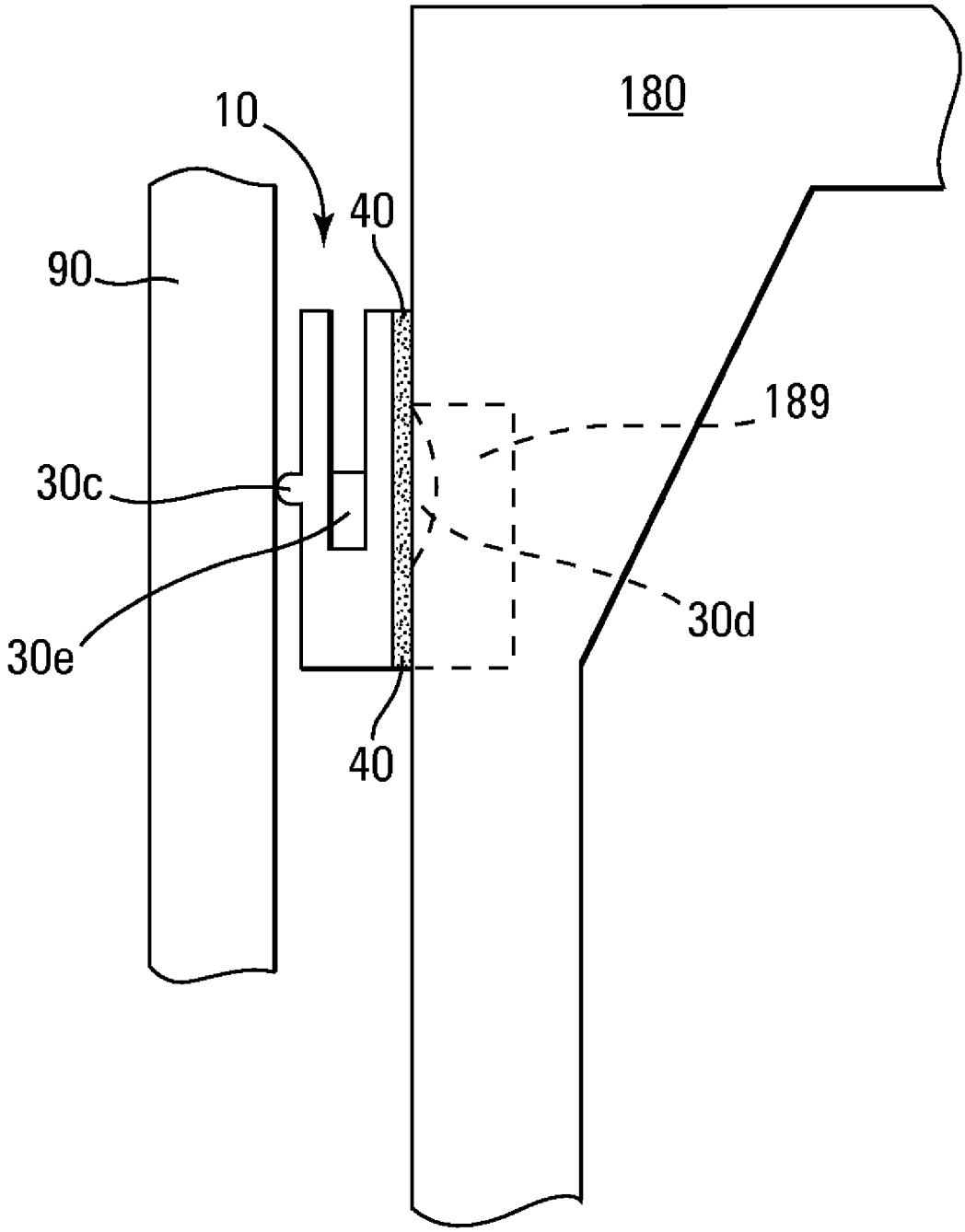
FIG. 5 is a side view of a bracket with the tool adhered to the bracket over a key-hole slot in the back of the bracket and held against a wall to be marked with the tool.

The tool 10 can also be used to quickly and easily hang an item having a mounting orifice, such as a bracket 180 having a key-hole slot 189, from a vertical surface 90. Referring to FIG. 5, the tool 10 is used by (i) removing the release liner 50 from the tool 10, (ii) inserting the second protuberance 30*d* on the tool 10 into the key-hole slot 189 in the bracket 180, (iii) pressing the tool 10 against the bracket 180 to ensure good adhesion of the pressure sensitive adhesive 40 to the bracket 180, (iv) supporting the bracket 180 with attached tool 10 relative to a vertical surface 90 at a desired hanging position and orientation, (v) pressing the supported bracket 180 against the vertical surface 90 with a force sufficient to cause the first protuberance 30*c* on the tool 10 to mark the vertical surface 90, (vi) moving the bracket 180 to expose the mark on the vertical surface 90, (vii) securing a mounting pin to the vertical surface 90 proximate the mark, and (viii) suspending the bracket 180 from the driven mounting pin by positioning the bracket 180 relative to the driven mounting pin so as to position the pin within the key-hole slot 189 in the bracket 180.

Suitable mounting pins include any of the customary mounting hardware used with sawtooth hangers 60 including specifically but not exclusively, nails and screws driven into the surface and hooks attached by a pressure-sensitive adhesive to the surface.

I claim:

1. A method of hanging an item equipped with a sawtooth hanger upon a vertical surface, comprising (a) obtaining a tool having (i) a front face, (ii) a laterally and longitudinally extending open-sided channel, and (iii) a protuberance projecting in a first transverse direction forward the front face of the tool, (b) sliding the sawtooth hanger attached to the item into the channel in the tool with the protuberance projecting away from the item, (c) supporting the item with attached tool relative to a vertical surface at a desired hanging position and orientation, (d) pressing the supported item against the vertical surface with a force sufficient to cause the protuberance on the tool to mark the vertical surface, (e) moving the item to expose the mark on the vertical surface, (f) securing a mounting pin to the vertical surface proximate the mark, and (g) suspending the item from the driven mounting pin by the sawtooth hanger on the item.

2. A method of hanging an item having a mounting orifice upon a vertical surface, comprising (a) obtaining a tool having (i) transversely spaced front and rear faces, (ii) a first protuberance projecting in a first transverse direction forward the front face of the tool, and (iii) a second protuberance projecting in a second transverse direction rearward the rear face of the tool, (b) inserting the second protuberance on the tool into the mounting orifice in the item, (c) supporting the item with attached tool relative to a vertical surface at a desired hanging position and orientation, (d) pressing the supported item against the vertical surface with a force sufficient to cause the first protuberance on the tool to mark the vertical surface, (e) moving the item to expose the mark on the vertical surface, (f) securing a mounting pin to the vertical surface proximate the mark, and (g) suspending the item from the driven mounting pin by positioning the item over the driven mounting pin so as to position the pin within the mounting orifice in the item.

3. The method of claim 2 wherein the tool includes a layer of a pressure sensitive adhesive on at least a portion of the rear face of the mass and a release liner covering the layer of pressure sensitive adhesive, and the method further comprises removing the release liner from the tool prior to inserting the second protuberance on the tool into the mounting orifice in the item so as to expose the pressure sensitive adhesive, whereby the pressure sensitive adhesive will contact and adhere to the item when the second protuberance on the tool is inserted into the mounting orifice in the item.

4. A tool comprising a mass having (i) transversely spaced front and rear faces, (ii) a laterally and longitudinally extending open-sided channel configured and arranged to accommodate insertion of a central portion of a sawtooth hanger into the channel, (iii) a first protuberance projecting in a first transverse direction forward the front face of the mass, and (iv) a second protuberance projecting in a second transverse direction rearward the rear face of the mass.

5. The tool of claim 4 further comprising a layer of a pressure sensitive adhesive on at least a portion of the rear face of the mass.

6. The tool of claim 4 further comprising a release liner covering the layer of pressure sensitive adhesive.

* * * * *